US005954308A

United States Patent [19]

Lane et al.

[11] Patent Number: 5,954,308

[45] Date of Patent: Sep. 21, 1999

[54] VOLLEYBALL NET CLAMPS

[75] Inventors: Mark R. Lane, Jefferson; Neal C. Squibb, Scranton; Leslie M. Arp, Jefferson, all of Iowa

[73] Assignee: American Sports International, LTD, Jefferson, Iowa

[21] Appl. No.: 08/859,481

[22] Filed: May 20, 1997

Related U.S. Application Data

[63] Continuation of application No. 08/752,319, Nov. 19, 1996, abandoned.

[51] Int. Cl.[6] ..... A01K 97/10

[52] U.S. Cl. ..... 248/539; 248/201; 248/229.16; 473/467; 24/339

[58] Field of Search ..... 248/534, 79, 214, 248/215, 227.2, 227.4, 231.81, 309.1, 313, 314, 316.7, 201, 229.16, 539, 541; 403/389, 391; 473/467, 494; 24/336, 339, 562

[56] References Cited

U.S. PATENT DOCUMENTS

| | | | |
|---|---|---|---|
| 1,760,592 | 5/1930 | Gift | 248/538 |
| 1,776,785 | 9/1930 | Davidson | 248/201 |
| 2,523,785 | 9/1950 | Sereno | 248/316.7 |
| 2,600,478 | 6/1952 | Butcher | 248/79 |
| 2,913,740 | 11/1959 | Eldridge | 5/503.1 |
| 3,860,240 | 1/1975 | Koch | 273/95 |
| 3,929,310 | 12/1975 | Peham | 248/231.81 |
| 3,940,139 | 2/1976 | Barnes | 273/95 |
| 4,100,652 | 7/1978 | Carlson | 24/3 R |
| 4,121,798 | 10/1978 | Schumacher | 24/336 |
| 4,871,141 | 10/1989 | Chen | 248/534 |
| 5,332,090 | 7/1994 | Tucker | 248/314 |
| 5,586,741 | 12/1996 | Cuneo | 248/231.81 |
| 5,647,568 | 7/1997 | Nettles | 248/316.7 |
| 5,651,522 | 7/1997 | Davis et al. | 248/221.11 |

*Primary Examiner*—Leslie A. Braun
*Assistant Examiner*—Gwendolyn Baxter
*Attorney, Agent, or Firm*—Zarley, McKee, Thomte, Voorhees & Sease

[57] ABSTRACT

A clamp for securing a vertically disposed elongated antenna to the horizontal edge of a volleyball net has a base wall and an oppositely disposed spaced clamping wall secured together at adjacent edges by a U-shaped live hinged portion. The clamping wall extends in a tapered direction towards the base wall to define a narrowed net receiving access lot opposite to the live hinge portion. A vertically disposed shoulder extends outwardly from an outer surface of the base wall, and a vertical bore is located in the shoulder to receive an end of an elongated antenna. The clamp members are comprised of a single piece of plastic material. An elongated lift member is on an elongated horizontal free edge of the clamping wall and extends outwardly from the access slot. A plurality of serrations are formed on an inner surface of the base wall opposite to the clamping wall. The shoulder on said base wall has a vertical length greater than the vertical height of the base wall.

9 Claims, 2 Drawing Sheets

VOLLEYBALL NET CLAMPS

CROSS-REFERENCE TO A RELATED APPLICATION

This application is a continuation of Ser. No. 08/752,319 filed on Nov. 19, 1996 now abandoned.

BACKGROUND OF THE INVENTION

A volleyball net is approximately 3 feet wide and 32 feet in length when stretched across the volleyball court. It normally is made of 4 inch square mesh of linen twine and is rigged at the top and bottom edges to a rope or cable in conventional manner.

The official volleyball rules require that a long vertically disposed antenna be suspended by the net at each sideline of the volleyball court so the antennas extend to a height of 2½ to 3½ feet above the net. The antennas are secured to the net at approximately 8½ inches from the ends thereof and are normally in the order of ⅝ths of an inch in diameter. The antennas are typically made of Fiberglas or the like.

The antennas are secured at the top and bottom of the net and define the lateral width of play of the volleyball court. If the ball touches one of the antennas, it is considered to be out of bounds. The antennas typically are secured to the upper and lower edges of the net by a pair of clamps. The lower clamp supports the bottom end of the antennas. This invention relates to the net clamps that support the antenna.

Existing antenna net clamps are normally comprised of a plurality of parts. Some of these clamps are of a bulky nature and are not always easily and quickly installed. Some clamps do not easily maintain their designated position with respect to the net.

It is therefore a principal object of this invention to provide volleyball net antenna clamps which can be easily and quickly affixed to the upper and lower edges of a volleyball net.

A further object of this invention is to provide volleyball net antenna clamps which are comprised of a single piece of material.

A still further object of this invention is to provide a volleyball antenna clamp that is refined in appearance and durable in use.

These and other objects will be apparent to those skilled in the art.

SUMMARY OF THE INVENTION

The clamps of this invention comprise a U-shaped clamp member having a vertically disposed base wall and an oppositely disposed spaced clamping wall secured together at adjacent edges by a U-shaped live hinge portion. The clamping wall extends in a tapered direction towards the base wall to define a narrowed net receiving access slot opposite to the live hinge portion. A vertically disposed shoulder extends outwardly from an outer surface of the base wall, and a vertical bore is located in the shoulder to receive an end of an elongated antenna. The clamp members are comprised of a single piece of plastic material. An elongated lip member is on an elongated horizontal free edge of the clamping wall and extends outwardly from the access slot. A plurality of serrations are formed on an inner surface of the base wall opposite to the clamping wall. The shoulder on said base wall has a vertical length greater than the vertical height of the base wall.

DESCRIPTION OF THE PREFERRED EMBODIMENT

Figure 1:
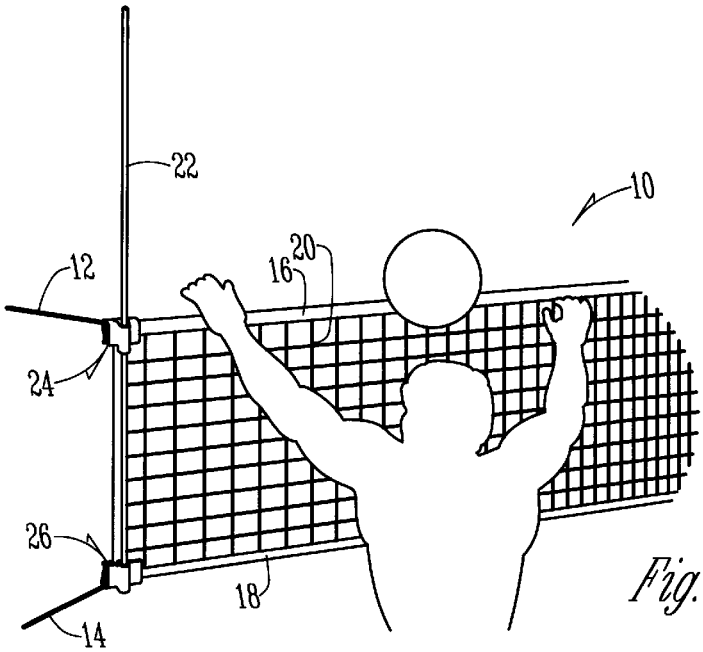
FIG. 1 is a partial perspective view of a volleyball net with the clamps of this invention secured thereto.

The volleyball net 10 previously described is supported in an elevated position by top cable 12 and bottom rope 14 which are secured to typical and conventional vertical standards (not shown). Net 10 has an upper sheath 16 which receives top cable 12 and a lower sheath 18 which receives rope 14. As previously indicated, the net 10 is comprised of a mesh material 20 which normally has 4 inch square openings therein.

An elongated antenna 22 is normally approximately 6 feet long and as previously indicated, extends 2½ to 3½ feet above net 10. It can be comprised of Fiberglas or the like and normally has a maximum diameter of approximately ⅝ths of an inch.

Antenna 22 is supported by an upper clamp 24 and a lower clamp 26. Each clamp is comprised of a base wall 28 and a clamping wall 30. Base wall 28 has a horizontal edge portion 32 and clamping wall 30 has a horizontal edge portion 36. The edge portions 32 and 36 are interconnected with a U-shaped portion 38 which is slightly resilient and serves as a live hinge between base wall 28 and clamping wall 30.

Clamping wall 30 is tapered towards base wall 28 and a narrow access slot 40 appears between the free edge 41 of the clamping wall 30 and base wall 28. A lip portion 42 extends longitudinally along the access wall 40.

Figure 2:
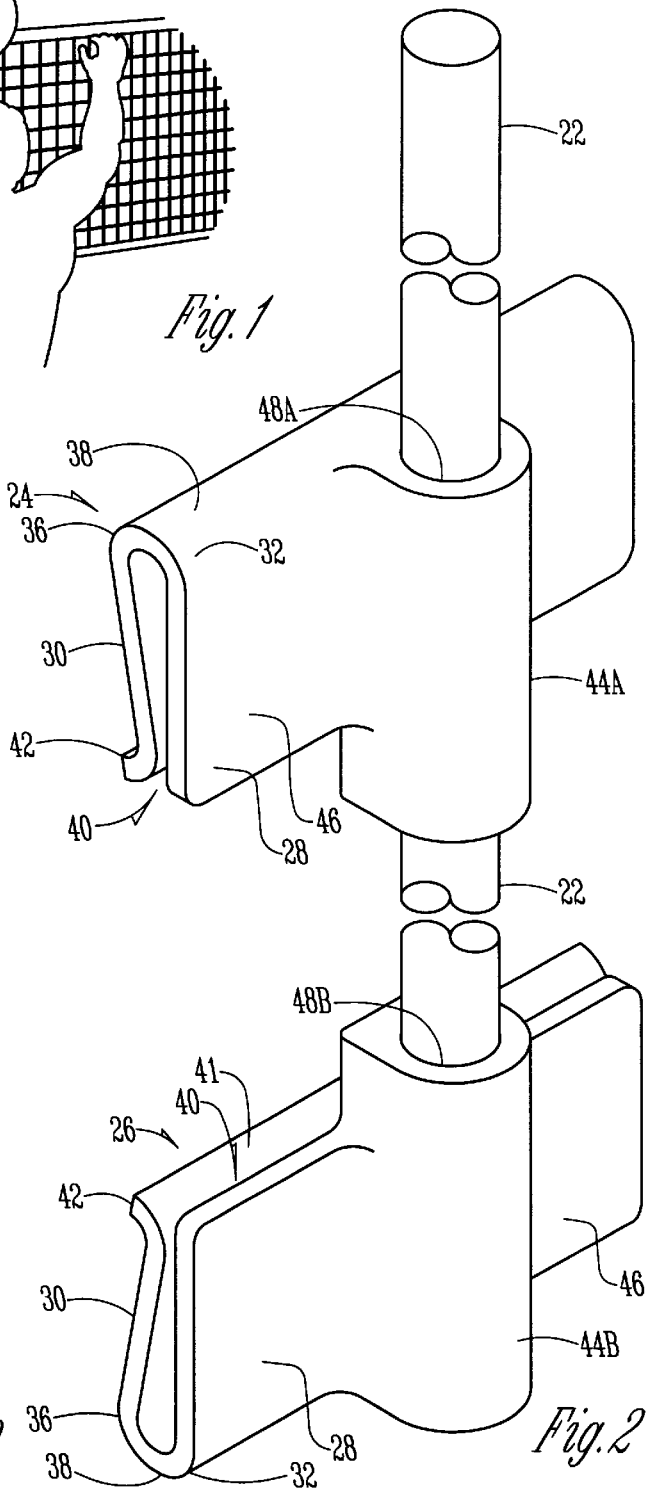
FIG. 2 is an exploded perspective view of the clamps of FIG. 1 supporting an antenna but disassembled from the volleyball net.
Figure 4:
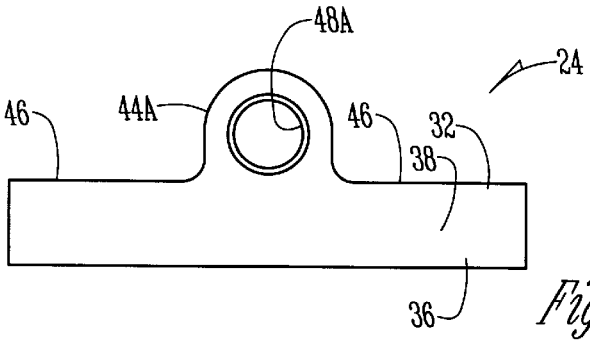
FIG. 4 is a top plan view thereof.
Figure 5:
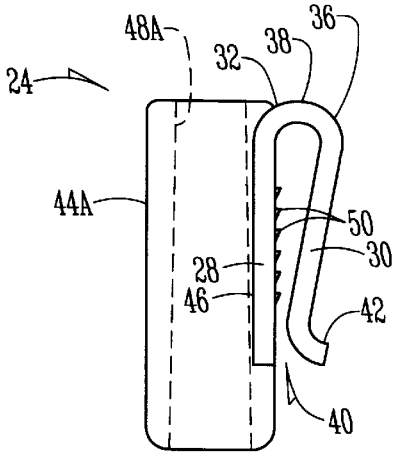
FIG. 5 is a typical side elevational view of the upper clamp as seen from the right hand end of the upper clamp in FIG. 2.
Figure 3:
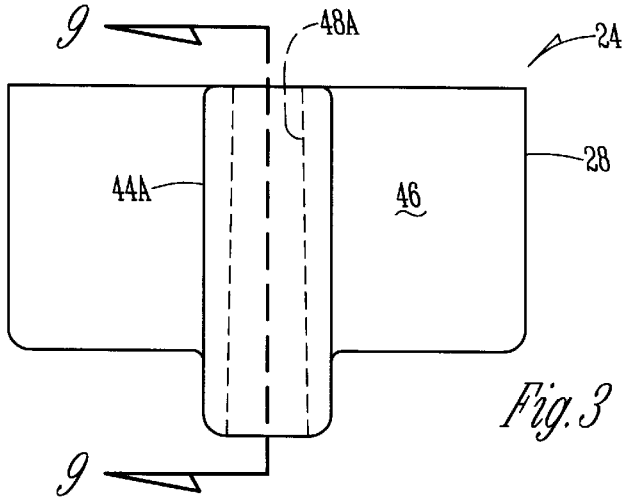
FIG. 3 is a rear perspective view of the upper clamp of FIG. 2.
Figure 6:
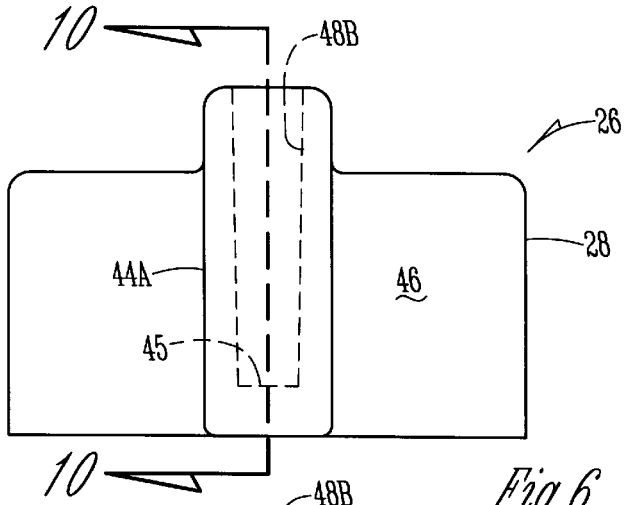
FIG. 6 is a rearward elevational view of the lower clamp shown in FIG. 2.
Figure 8:
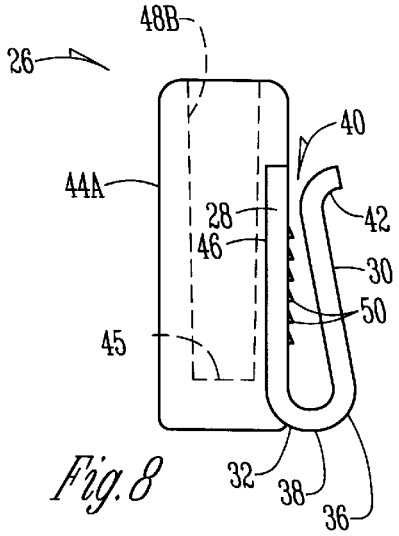
FIG. 8 is a typical end elevational view thereof as seen from the right-hand end of FIG. 6.
Figure 7:
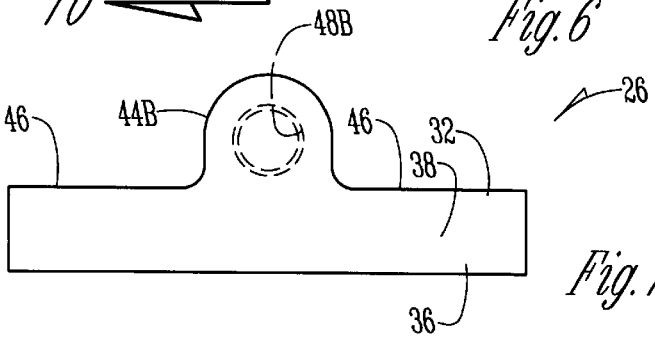
FIG. 7 is a bottom plan view of the lower clamp as seen from the bottom of FIG. 6.

As shown in FIG. 2, upper clamp 24 has a vertical shoulder 44A formed in the center of base wall 28 on the outside surface 46 of the base wall. A vertical bore 48A extends through shoulder 44A. Similarly, a vertical shoulder 44B is formed on the wall 28 of clamp 26 on the outer surface 46 thereof. A vertical bore 44A is formed in vertical shoulder 44B but the lower end thereof terminates in bottom 45.

Figure 9:
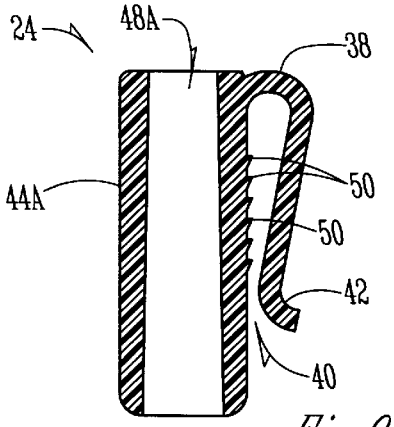
FIG. 9 is a sectional view of the upper clamp taken on line 9—9 of FIG. 3.
Figure 10:
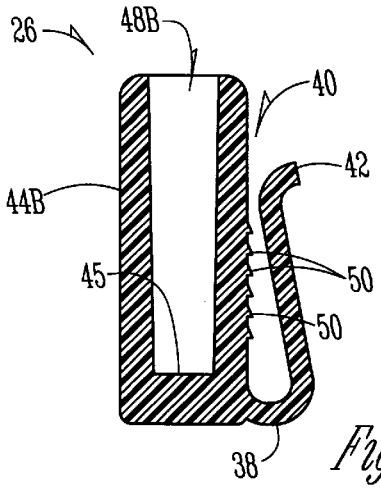
FIG. 10 is a sectional view taken on line 10—10 of FIG. 6.

A plurality of horizontal serrations 50 are formed on the outside of base wall 28 downwardly within slot 40 to frictionally engage the edge of the net that is inserted within the access slot 40 (see FIGS. 9 and 10).

As shown in FIGS. 1 and 2, the upper clamp 24 is placed on the upper sheath 16 by inserting the sheath within the access slot 40 of the upper clamp 24. Similarly, the lower clamp 26 is secured to the lower sheath 18 of net 10 by introducing the sheath 18 into the access slot 40 of the lower clamp. The clamping walls 30 of the upper and lower clamps slightly yield and pivot away about U-shaped portion 38 upon the introduction of the sheaths into the access slot 40 of the respective clamps. The spring-like characteristics of the material of the clamps, which is preferably polypropylene or the like, forcibly clamps the cable or rope filled sheaths within the confines of the slot created by the adjacent base and clamping walls 28 and 30, respectively.

When the clamps are in position as described and are disposed in vertical relation to each other, the lower end of antenna 22 is extended through the bore 48A in vertical shoulder 44A, and is thence slidably extended therethrough so that the lower end of the antenna enters the bore 48B in lower clamp 26. The lower end of the antenna extends downwardly to the bottom 45 in the bore 48B to limit its downward movement.

The clamps of this invention can be easily and quickly mounted on the net as described above. Since the clamps 24 and 26 are comprised of a single integral unitary structure, it is not necessary to adjust a plurality of moving parts in order for the clamps to be effective.

The shoulders 44A and 44B have a vertical height greater than the base walls 28 of the clamps so as to provide additional longitudinal support for the antennas 22.

The clamps 24 and 26 along with antenna 22 can be easily and quickly removed from the net 10 by reversing the foregoing procedure.

It is therefore seen that this invention will accomplish at least its stated objectives.

What is claimed is:

1. A volleyball net assembly comprising, a volleyball net supported in a vertical plane and having an elongated sheath attached along its upper and lower edges, an antenna assembly on at least one end of said net and comprising a pair of U-shaped clamp members secured to each of said sheaths, each clamp member comprising a vertically disposed base wall having a horizontal edge portion, and having a spaced clamping wall having a horizontal edge portion opposite to said base wall with a U-shaped portion interconnecting the horizontal edge portions of said base wall and said clamping wall, said clamping wall extending in a tapered direction towards said base wall to define a narrowed net receiving access slot adjacent a horizontal free edge opposite to said U-shaped portion, a vertically disposed shoulder extending outwardly from an outer surface of said base wall, a vertical bore completely enclosed by a cylindrical wall in said shoulder to receive an end of the elongated antenna;

said clamp member having a horizontal length greater than the height of said shoulder to enhance the stability of said clamp member on the net;

said vertical bores in said clamps being aligned and the elongated antenna extending through said aligned bores.

2. The assembly of claim 1 wherein the said clamp assembly is comprised of a single piece of plastic material.

3. The assembly of claim 1 wherein said U-shaped portion is a live hinge which resiliently holds said clamping wall in its tapered orientation with respect to said base wall.

4. The clamp of claim 3 wherein said clamp member is comprised of a single piece of plastic material.

5. The assembly of claim 1 wherein said bore in said shoulder extends completely through said shoulder.

6. The assembly of claim 1 wherein said bore in said shoulder extends only partially through said shoulder.

7. The assembly of claim 1 wherein an elongated lip member is on said horizontal free edge of said clamping wall and extends outwardly from said access slot.

8. The assembly of claim 1 wherein said shoulder has a vertical length greater than the vertical height of said base wall.

9. The assembly clamp of claim 1 wherein said shoulder has a vertical length greater than the vertical height of said base wall.

* * * * *